US006681973B2

(12) United States Patent
Crumrine

(10) Patent No.: US 6,681,973 B2
(45) Date of Patent: Jan. 27, 2004

(54) EXTENDABLE WAISTBELT SYSTEM

(76) Inventor: David A. Crumrine, 311 Ptarmigan St., Golden, CO (US) 80403

( * ) Notice: Subject to any disclaimer, the term of this patent is extended or adjusted under 35 U.S.C. 154(b) by 0 days.

(21) Appl. No.: 09/930,378

(22) Filed: Aug. 15, 2001

(65) Prior Publication Data

US 2003/0034371 A1 Feb. 20, 2003

(51) Int. Cl.[7] ..... A45F 3/04

(52) U.S. Cl. ..... 224/637; 224/638; 224/641; 224/642; 224/643

(58) Field of Search ..... 2/319, 312, 311; 224/637, 638, 604, 641, 642, 643, 258, 259, 260, 264; 602/19

(56) References Cited

U.S. PATENT DOCUMENTS

| | | | | |
|---|---|---|---|---|
| 3,938,718 A | | 2/1976 | Madison | |
| 4,318,502 A | | 3/1982 | Lowe et al. | |
| 4,858,801 A | * | 8/1989 | Sameniego | 224/264 |
| 5,064,108 A | * | 11/1991 | Headley | 224/663 |
| 5,183,194 A | | 2/1993 | Shirdavani | 224/224 |
| 5,429,287 A | | 7/1995 | Frano | 224/215 |
| 5,725,139 A | | 3/1998 | Smith | 224/637 |
| 5,823,414 A | * | 10/1998 | Gal et al. | 224/637 |
| 5,836,489 A | | 11/1998 | Swetish | 224/262 |
| 5,860,769 A | | 1/1999 | Seligman | |
| 5,954,253 A | | 9/1999 | Swetish | 224/631 |
| 6,536,641 B1 | * | 3/2003 | Sundara et al. | 224/637 |

OTHER PUBLICATIONS

Mountainsmith; "Pack Know How", online at www.mountainsmith.com; Jun. 1, 2002; http://mountainsmith.com/info/pack.js.

* cited by examiner

*Primary Examiner*—Stephen K. Cronin

(57) ABSTRACT

A waistbelt for stabilizing a load, the load potentially carried within a backpack. The waistbelt may be worn around a user's waist and fastened together by a locking buckle. The waistbelt may be attached to a backpack, as part of a backpack system, by straps that are directly affixed to the waistbelt. The waistbelt may comprise padding that rests on the user's hips. A support region of the waistbelt can minimize shifting and swaying of the load carried in a backpack. The support region of the waistbelt may be extendable, and may be extended by movably attached waistbelt extensions. The waistbelt extensions may reduce reliance upon provide extendable support for varying waist sizes. The waistbelt extensions may reduce reliance upon support from buckling straps, thereby potentially reducing chafing, abrasions, and fatigue to the user.

103 Claims, 7 Drawing Sheets

EXTENDABLE WAISTBELT SYSTEM

BACKGROUND OF THE INVENTION

1. Field of the Invention

The present invention relates in general to waistbelts and, more particularly, to an extendable waistbelt for supporting a backpack on a person's waist.

2. Description of the Prior Art

Backpacks are well known and come in a variety of shapes and sizes. Often a backpack system may have a waistbelt for stabilizing a load contained with the backpack. Such waistbelts are typically constructed of fabric and may provide fabric compression straps that may be sewn directly to the waistbelts. Such compression straps can be attached to a backpack with a common fastener, such as sliding three-bar buckles located on the backpack. Most waistbelts also have fabric buckling straps that may be sewn directly to the waistbelt and may be tightened to allow a user to fasten and tighten the waistbelt securely around the user's waist. The buckling straps are often threaded through sliding three-bar buckle fasteners, however, other fasteners may be used. Many waistbelts are padded for the user's comfort and offer support for at least some of the weight of the backpack on the user's hips. When fit and worn properly, the waistbelt may reduce shifting and swaying of the backpack load on the user's hips and waist, thereby stabilizing the load.

Previous waistbelts may have included a padded portion on the waistbelt to support the load of the backpack. The padded portion allows the user to comfortably support the load of the backpack on the user's waist that might not otherwise be possible with bare straps. Such previous attempts at padded portions of waistbelts are usually made with a single, non-adjustable length. Previous waistbelts may include buckling straps which are sewn directly to the terminal ends of the waistbelt and the waistbelt is adjusted to fit various waist sizes by sliding the sliding three-bar buckle fasteners along some portion of the lengths of the buckling straps. Due to the single, non-adjustable length of the padded portion of the waistbelt, there may be many instances in which the padded portion of the waistbelt on the belt itself does not sufficiently surround the user's waist. Thus, the buckling straps themselves, may have to support a significant amount of the backpack weight, transferring the load from the straps to the user's hips and waist, which can be very uncomfortable. For example, a person with a larger waist size may be forced to place the sliding three-bar buckle fasteners farther from the belt and padded portion and toward distal ends of the buckling strap to effect a lengthening of the belt. Therefore, a larger portion of the backpack load gets supported on the person's waist and hips by the uncomfortable buckling straps instead of being supported by the more comfortable waistbelt padded portion.

Adequate support and stability as that of the padded portion of previous waistbelts may not be achieved by the buckling straps. The load that is carried in the backpack may shift and sway substantially. Once the load begins to shift and sway, the waistbelt may become uncomfortable and cause fatigue. Moreover, as previous waistbelts rub against the user's body, the waistbelt may cause chafing and abrasions.

Many suppliers and retailers of more upscale backpacks have attempted to address problems of past attempts by providing different lengths of waistbelts, which can be installed on particular backpacks to custom fit the backpacks with waistbelts that may match more closely the size of a user's waist. But this solution has it drawbacks, not the least of which is the necessity of having to carry an inventory of more waistbelts in order to meet the custom sizing requirements. Also a person with a smaller waist cannot wear a backpack fitted with a larger sized waistbelt, so there is little versatility in this approach.

Hence, there is a need for an adjustable waistbelt that offers support to users with different waist sizes, such that the backpack load is stabilized and distributed comfortably around a particular user's waist and hips.

SUMMARY OF THE INVENTION

It is a general object of the present invention to provide support to a user carrying a backpack.

It is a more specific object of this invention to limit shifting and swaying of a backpack load by providing a more comfortable and supportive waistbelt.

It is also a more specific object of this invention to variably extend the length of the waistbelt at which support and comfort are provided by telescoping the length of the waistbelt at terminal ends of the waistbelt.

Yet another more specific object of this invention is to prevent chafing and abrasions to a user who would normally have to rely on buckling straps for support.

Additional objects, advantages, and novel features of the invention shall be set forth in part in the description that follows, and in part will become apparent to those skilled in the art upon examination of the following description or may be learned by the practice of the invention. The objects and the advantages may be realized and attained by means of the instrumentalities and in combinations particularly pointed out in the appended claims.

To achieve the foregoing and other objects and in accordance with the purposes of the present invention, as embodied and broadly described herein, one embodiment of the present invention may comprise the waistbelt comprising waistbelt inserts that reside in pockets formed in the terminal ends of the waistbelt. The waistbelt inserts may be movably affixed to the terminal ends by means of sliding three-bar buckles attached directly to the waistbelt inserts. Buckling straps that are affixed to the terminal ends of the waistbelt may then be pulled through the sliding three-bar buckles to provide a movable attachment. Adjustment of the sliding three-bar buckle along the length of the buckling strap can then extend the length of the waistbelt.

To achieve the foregoing and other objects and in accordance with the purposes of the present invention, as embodied and broadly described herein, the waistbelt may alternatively be comprised of straps that harness the waistbelt extensions at the terminal ends of the waistbelt. The waistbelt extensions may be movably affixed to the terminal ends by means of sliding three-bar buckles attached directly to the waistbelt extensions. Buckling straps that are affixed to the waistbelt so as not to preclude a telescoping motion of the waistbelt extensions may then be pulled through the sliding three-bar buckles to provide a movable attachment. Adjustment of the sliding three-bar buckle along the length of the buckling strap can then extend the length of the waistbelt.

DETAILED DESCRIPTION OF THE PREFERRED EMBODIMENT

Figure 1:
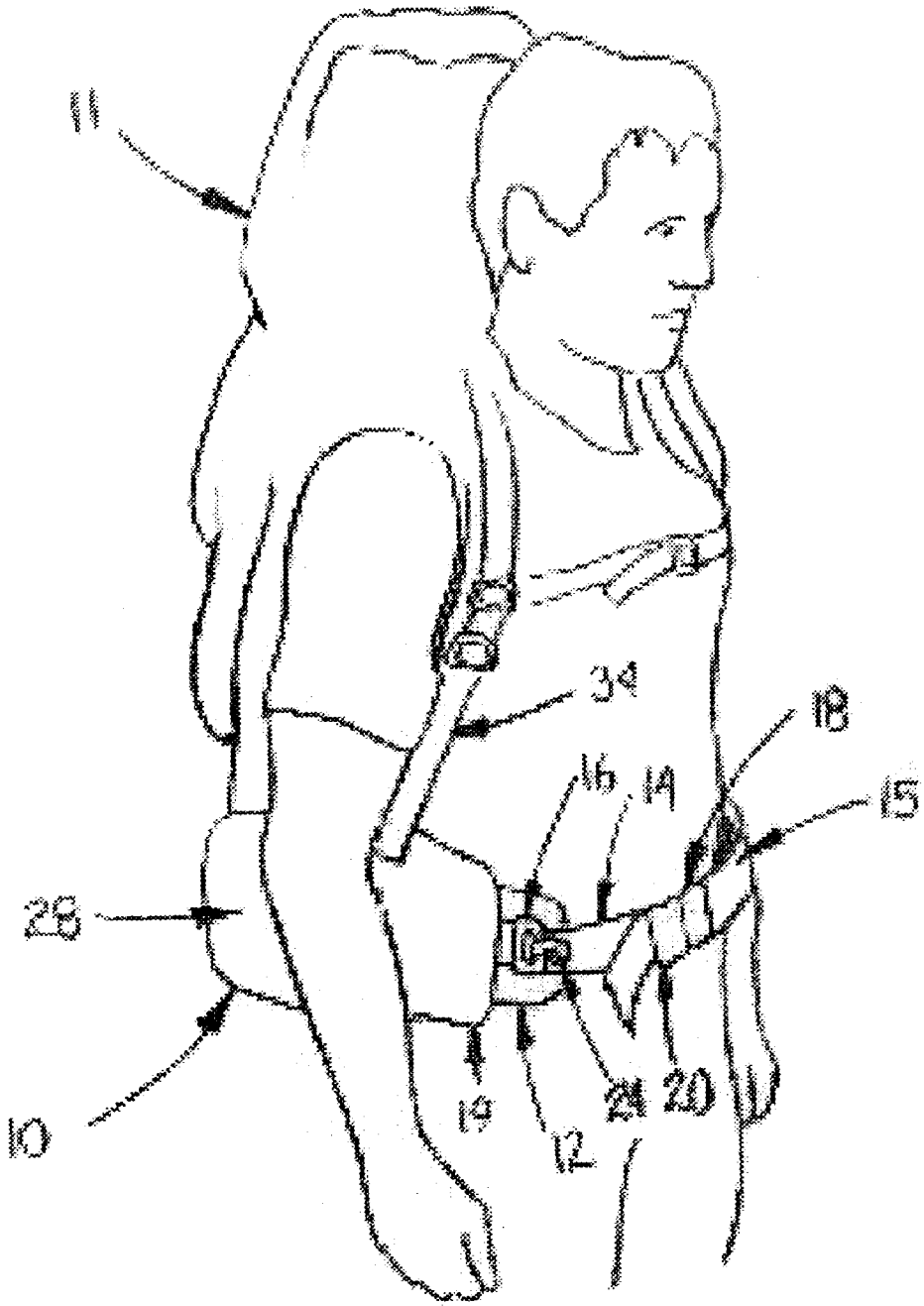
FIG. 1 shows a view of the waistbelt embodiment as worn on a user carrying a backpack.

An extendable waistbelt 10 according to the present invention is shown in FIG. 1 supporting a backpack 11 on a person's waist and hips. The extendable waistbelt 10 is padded and surrounds most of the person's waist. Padding for the belt is situated on a person's hips when worn and may be sewn within the waistbelt 10 or attached to the waistbelt 10 as pads. The waistbelt 10, as shown, comprises padding sewn within the waistbelt 10 to form a padded region 28. The waistbelt 10 in combination with the padded region 28 support the load of back pack 11 and distributes the load evenly and comfortably to the person's waist and hips. Buckling straps 14 and 15 are respectively affixed to terminal ends, such as terminal end 19, of the waistbelt 10 and are used to fasten and retain the waistbelt 10 around the person's waist. Any suitable fastener, such as the sliding three-bar locking buckle 18, 20, can be used to fasten and secure the buckling straps 14 and 15. Compression straps, such as compression 34, are also attached directly to the waistbelt 10 for attaching to the backpack 11. The compression straps assist in the stabilization of the load carried in backpack 11.

Waistbelt inserts, such as waistbelt insert 12, are fitted into pockets formed in the terminal ends of the waistbelt 10. The waistbelt insert 12 is movably attached to the buckling strap using a sliding three-bar buckle, such as sliding three-bar buckle 16 as shown on the buckling strap 14. Attached to the sliding three-bar buckle 16 is a fabric loop 24 that renders leverage to the user for adjusting the waistbelt 10. The waistbelt insert 12 makes it possible for the user to extend the waistbelt 10 as to render additional support in the event of a larger waist size.

Figure 2:
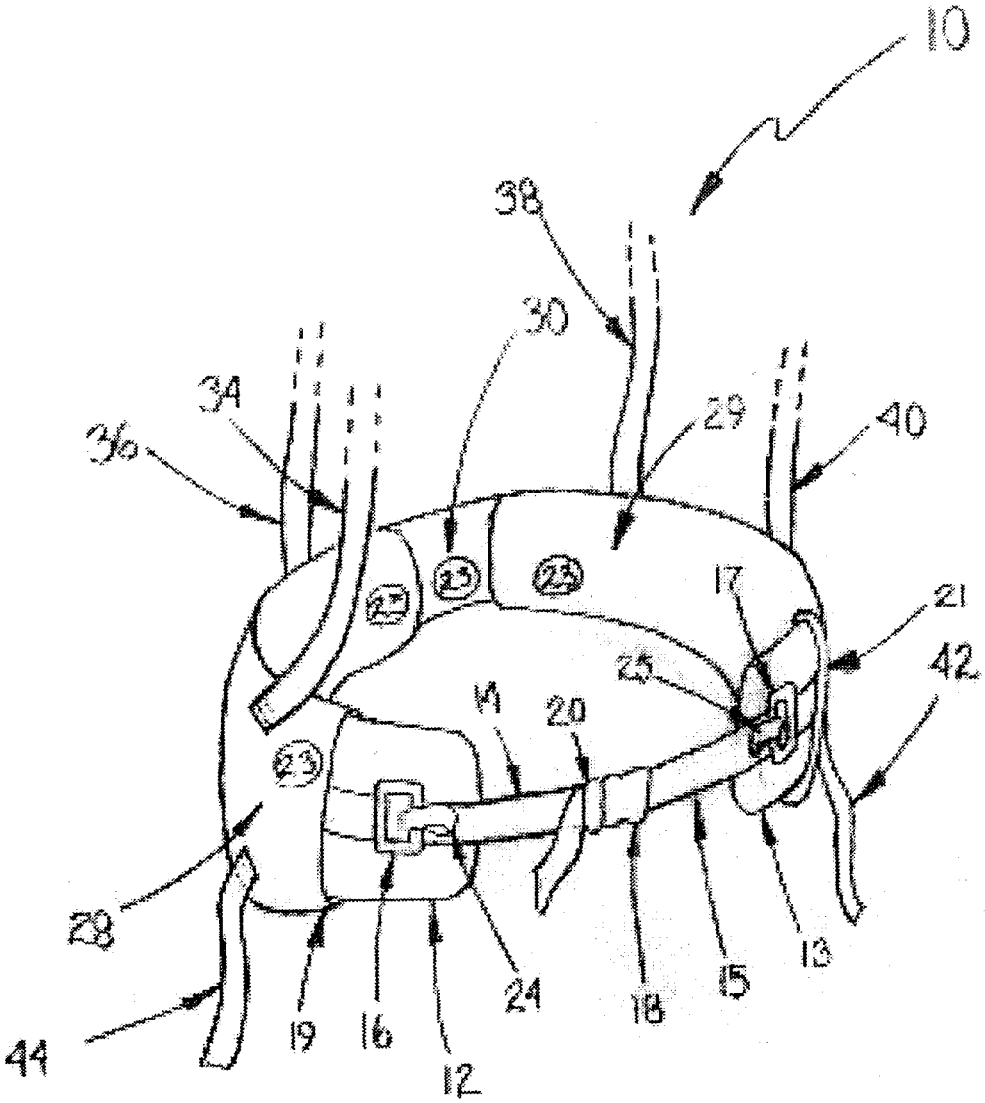
FIG. 2 shows an isometric view of an embodiment of the waistbelt.

An isometric view of the extendable waistbelt 10 is shown in FIG. 2. The waistbelt 10 comprises a belt band 23, labeled as an encircled 23, that further comprises three regions, two padded regions 28 and 29 and an unpadded region 30. Compression straps 34, 36, and 44 are directly attached to the padded region 28 and compression straps 38, 40, and 42 are directly attached to the padded region 29 for further attachment, such as the compression strap 34 to the backpack 11 as shown in FIG. 1. From this view it can be seen that buckling straps 14 and 15 are respectively attached to the terminal ends 19 and 21 of the belt band 23. Pockets are fashioned into the terminal ends 19 and 21 of the belt band 23 and are used to respectively hold the waistbelt inserts 12 and 13. The waistbelt inserts 12 and 13 have sliding three-bar buckles 16 and 17 respectively attached to surfaces of the waistbelt inserts 12 and 13. Although the buckling straps 14 and 15 are respectively attached to the terminal ends 19 and 21, the buckling straps could be attached to the belt band 23 in a variety of other means to produce essentially the same result. The buckling straps 14 and 15 are respectively woven through the sliding three-bar buckles 16 and 17 to respectively provide a movable attachment for the waistbelt inserts 12 and 13. Fabric loops 24 and 25 are respectively attached to the sliding three-bar buckles 16 and 17 and assist the user in adjustment of the respective waistbelt inserts 12 and 13. By pulling on the fabric loops 24 and 25, which respectively pulls the waistbelt inserts 12 and 13, the user can extend the length of the waistbelt 10.

The buckling straps 14 and 15 provide attachment to secure the waistbelt 10 to the user's waist. A locking mechanism, comprising sliding three-bar locking buckle 18, 20, provides the attachment of buckling strap 14 to buckling strap 15. However, it should be noted that the attachment of buckling strap 14 to buckling strap 15 could be fashioned in a myriad of ways, such as simply tying the buckling straps 14 and 15 together. The sliding three-bar locking buckle 18, 20 is further comprised of a sliding three-bar lock insert 18 and a sliding three-bar lock 20. The sliding three-bar lock insert 18 is movably attached to the buckling strap 14 by weaving the buckling strap 14 through the sliding three-bar lock insert 18. Similarly, buckling strap 15 is woven through the sliding three-bar lock 20. Respective adjustments of the sliding three-bar lock insert 18 and the sliding three-bar lock 20 serve to tighten the waistbelt 10.

Figure 3:
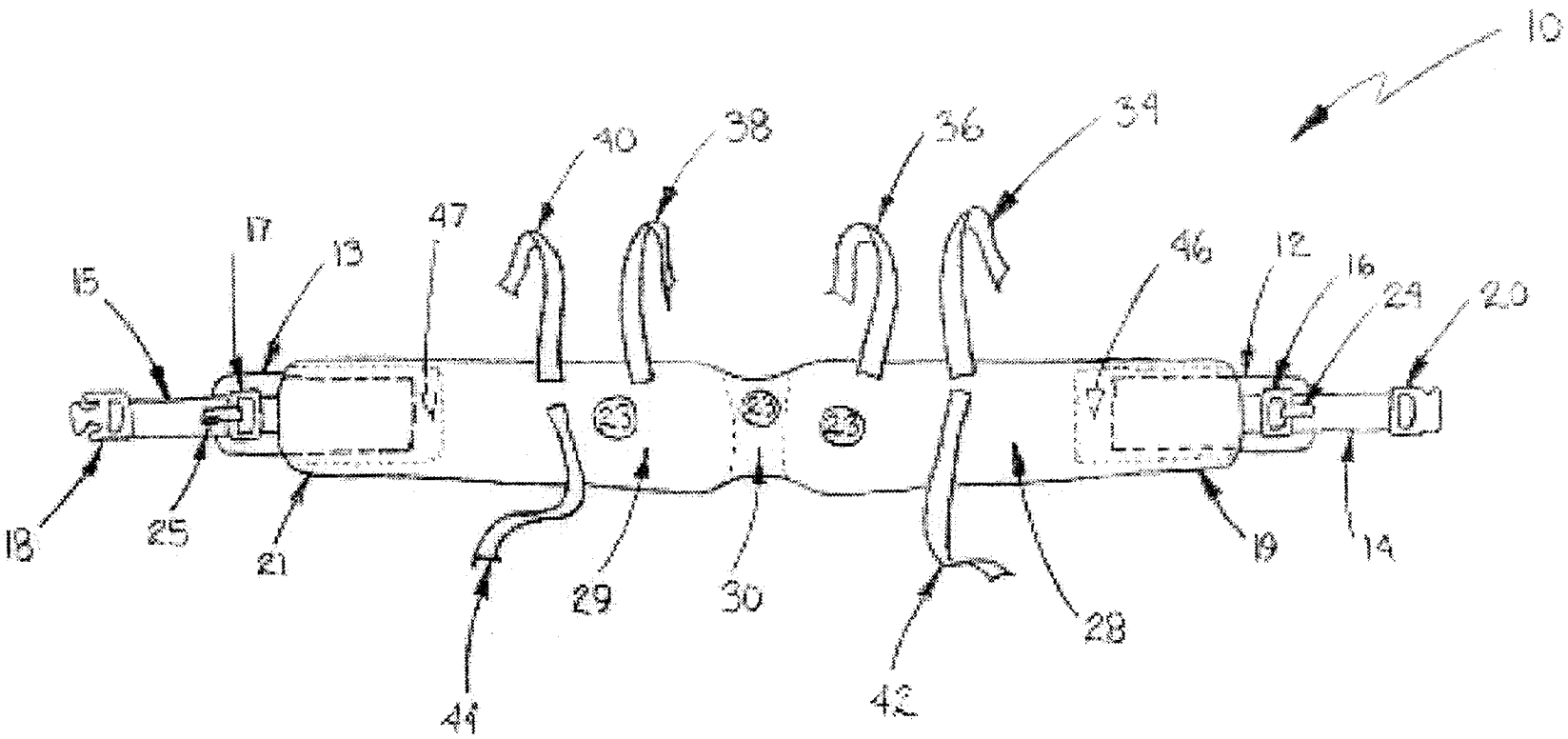
FIG. 3 illustrates a profile view of the waistbelt embodiment as would be seen exterior to the user.

Turning to FIG. 3 is a profile view of the waistbelt 10 embodiment as would be seen exterior to the user. The profile view shows the belt band 23, again labeled as an encircled 23, comprised of the two padded regions 28 and 29 and the unpadded region 30. The unpadded region 30 separates the two padded regions 28 and 29. This illustration shows an exemplary embodiment, however, other embodiments of the belt band 23 could include only a single padded region or even comprise more than two padded regions. Also illustrated is the approximate placement of compression straps 34, 36, and 42 on padded region 28 and compression straps 38, 40, and 44 on padded region 29. It should be noted that the placement and number of the compression straps, such as compression straps 34, 36, 42, 38, 40, and 44, could be varied to make the waistbelt 10 compatible with a variety of backpack products. Pockets 46 and 47 are respectively fashioned into the terminal ends 19 and 21 and are used to respectively harness the waistbelt inserts 12 and 13. As stated, the waistbelt inserts 12 and 13 are respectively and movably attached to the terminal ends 19 and 21 of the belt band 23. The movable attachments are procured through the use of sliding three-bar buckles 16 and 17 being respectively attached to the buckling straps 14 and 15. The sliding three-bar lock insert 18 is movably attached to the buckling strap 15 and the sliding three-bar lock 20 is movably attached to the buckling strap 14. The sliding three-bar lock insert 18 and sliding three-bar lock 20 form the sliding three-bar locking buckle 18, 20 when fastened together.

Figure 4:
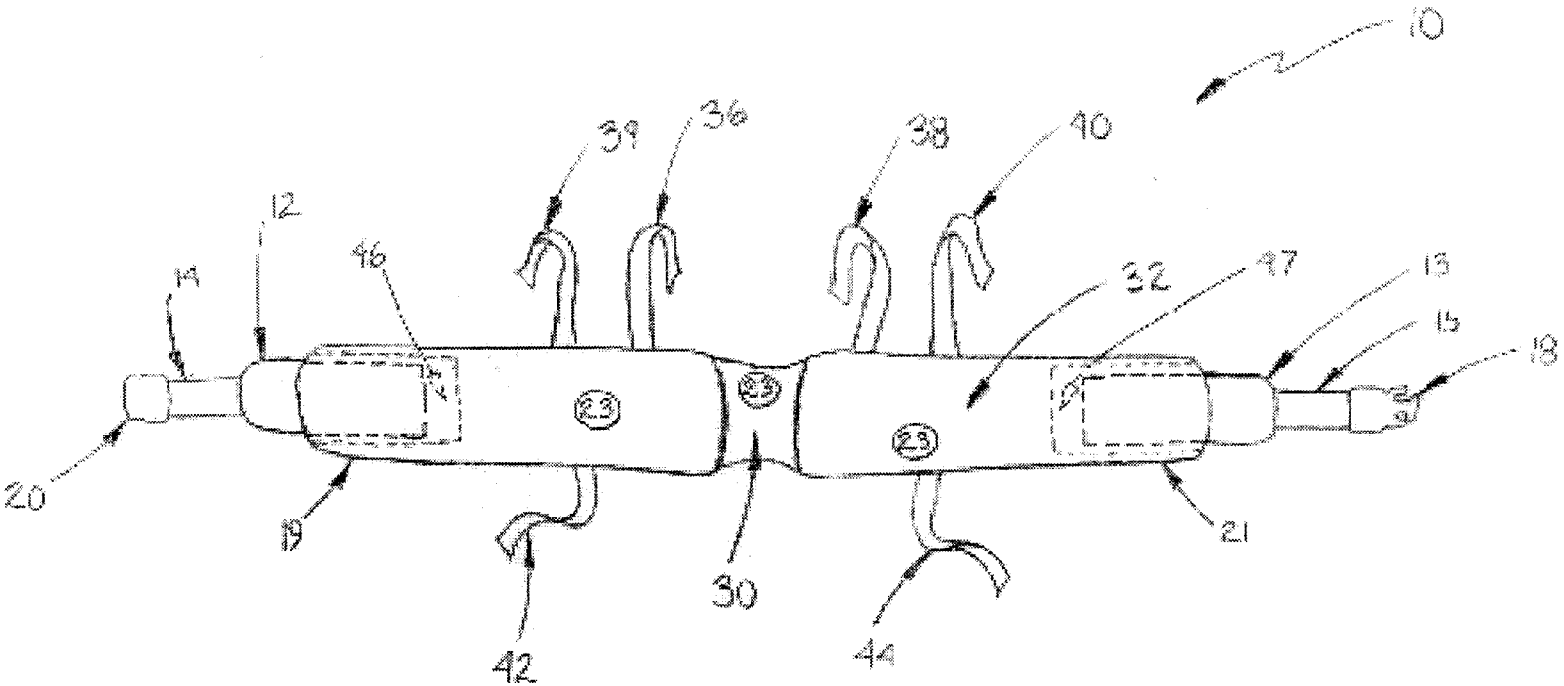
FIG. 4 illustrates a profile view of the waistbelt embodiment as would be seen adjacent to the user.

FIG. 4 shows a view of the waistbelt 10 that shows a surface that is worn adjacent to the user. Again, the pockets 46 and 47 are respectively located at the terminal ends 19 and 21. The pockets 46 and 47 are viewed as dotted lines to illustrate that the pockets 46 and 47 are located within the respective terminal ends 19 and 21 of the padded regions 28 and 29.

Figure 5:
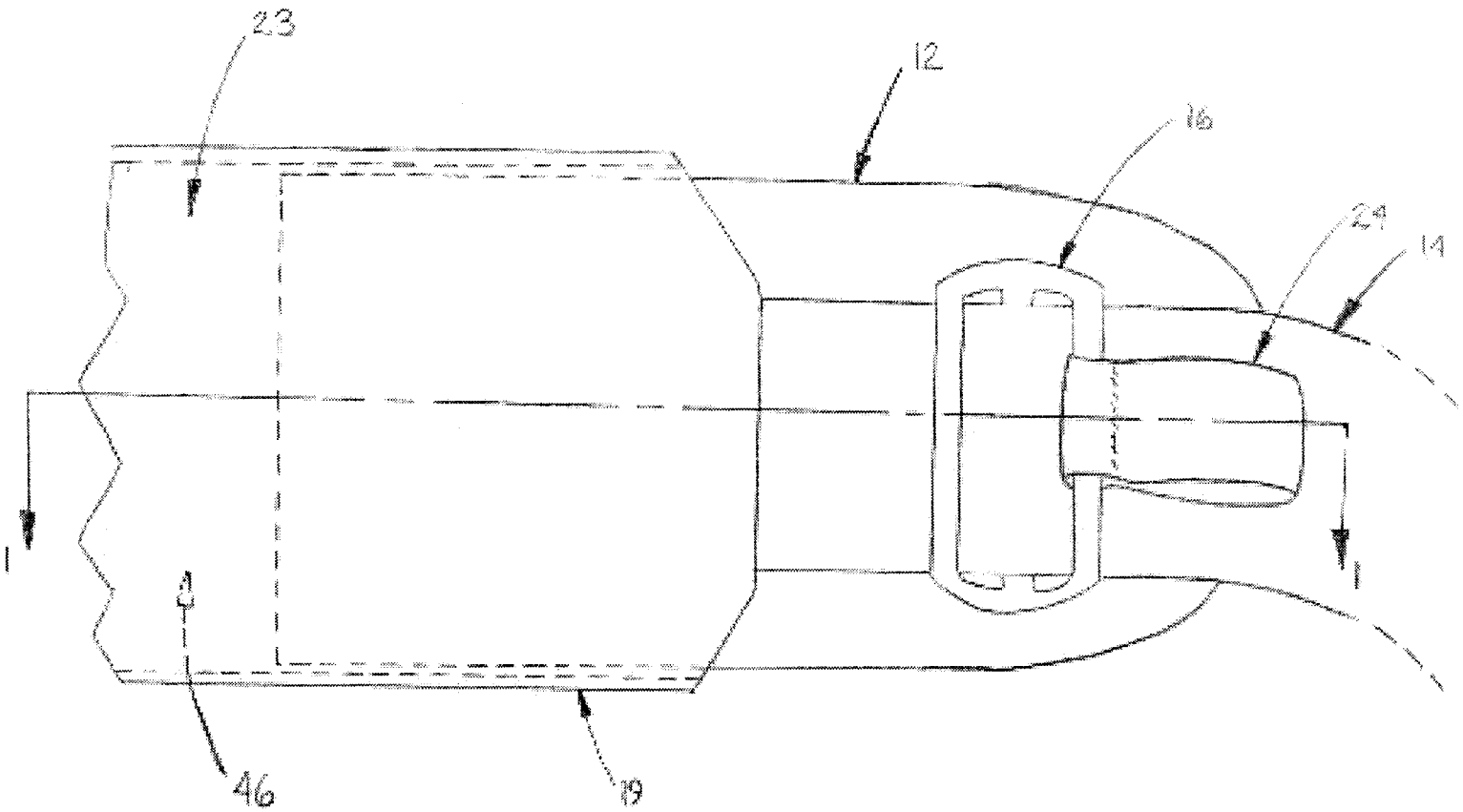
FIG. 5 illustrates a profile view of a terminal end of the waistbelt embodiment to include the waistbelt insert.

A waistbelt insert 12 according to the present invention is viewed in FIG. 5 and is shown as inserted into the pocket 46 formed in the terminal end 19 of the belt band 23. The waistbelt inserts 12 and 13 are similar in design, as are the pockets 46 and 47, and the terminal ends 19 and 21. For simplicity, the waistbelt insert 12 will be discussed as it is harnessed by the pocket 46 of terminal end 19. The waistbelt insert 12 comprises sliding three-bar buckle 16 directly affixed to a surface of the waist belt insert 12. The fabric loop 24 is attached to the sliding three-bar buckle 16. The buckling strap 14 is attached to the terminal end 19 of the belt band 23. The buckling strap 14 is woven through the sliding three-bar buckle 16 and provides a movable attachment to the waistbelt insert 12. The waistbelt insert 12 is held within the pocket 46 of terminal end 19. Pocket 46 allows the waistbelt insert 12 to telescope in and out of the pocket 46 while being movably attached to the buckling strap 14. To telescope the waistbelt insert 12 out of the pocket 46, and thus lengthen the waistbelt 10, the user might pull on the fabric loop 24 in a direction away from the terminal end 19 of the belt band 23. To telescope the waistbelt insert 12 into the pocket 46, the user might pull the sliding three-bar buckles towards the terminal end 19 of the belt band 23. An alternative embodiment of the invention might have an additional fabric loop to assist the user in pulling the sliding three-bar buckle towards the direction of the terminal end of the belt band 23. A cross-sectional view better illustrates that which is described, therefore, a line 1 is drawn through the belt to represent a direction of the cross-sectional view of the present invention, and is shown in FIG. 6.

Figure 6:
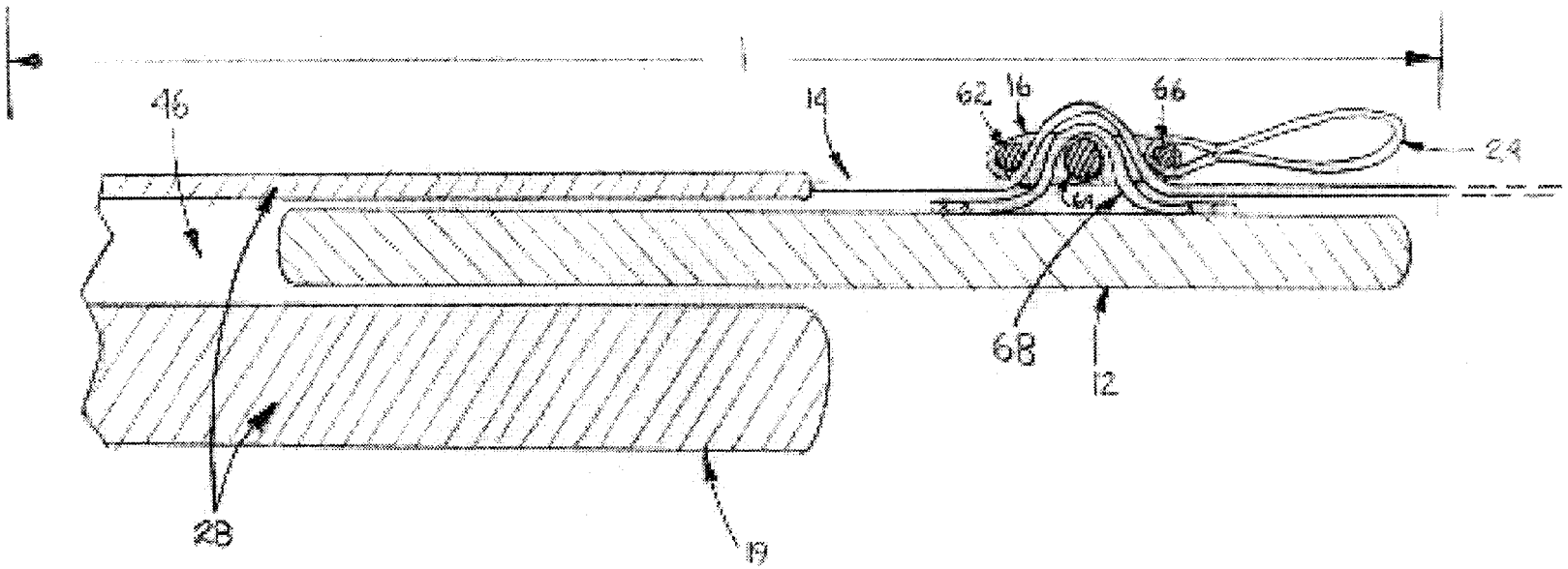
FIG. 6 illustrates a cross sectional view of the terminal end of the waistbelt embodiment as shown in FIG. 5.

A cross-sectional view of the present invention as shown in FIG. 5 is illustrated in FIG. 6. The pocket 46 is formed from a layering of first and second surfaces of the padded region 28. The waistbelt insert 12 resides in the pocket 46. The waistbelt insert 12 has sliding three-bar buckle 16 directly attached to a surface of the waistbelt insert 12 by means of a strap 68. The strap 68 is woven under a bar 62 of the sliding three-bar buckle 16, over a bar 64 of the sliding three-bar buckle 16, and under a bar 66 of the sliding three-bar buckle 16. The buckling strap 14 is directly affixed to the terminal end 19 on the surface 32 and movably attached to the waistbelt insert 12. The buckling strap 14 is woven through the sliding three-bar buckle 16 in a manner that is similar to that of the strap 68. The buckling strap 14 is woven under the bar 62 of the sliding three-bar buckle 16, over the bar 64 of the sliding three-bar buckle 16, and under the bar 66 of the sliding three-bar buckle 16. This method of attachment of the buckling strap 14 to the waistbelt insert 12 provides a movable attachment to the waistbelt insert 12. The fabric loop 24 is attached to the bar 66 of the sliding three-bar buckle 16 to provide leverage to the user when telescoping the waistbelt insert 12 away from the terminal end 19 of the belt band 23. It should be prevalent to one skilled in the art that the fabric loop 24 may be fashioned and affixed in a variety of means such as attaching a fabric loop to the bar 62 of the sliding three-bar buckle 16, attaching multiple fabric loops or even no fabric loop at all.

Figure 7:
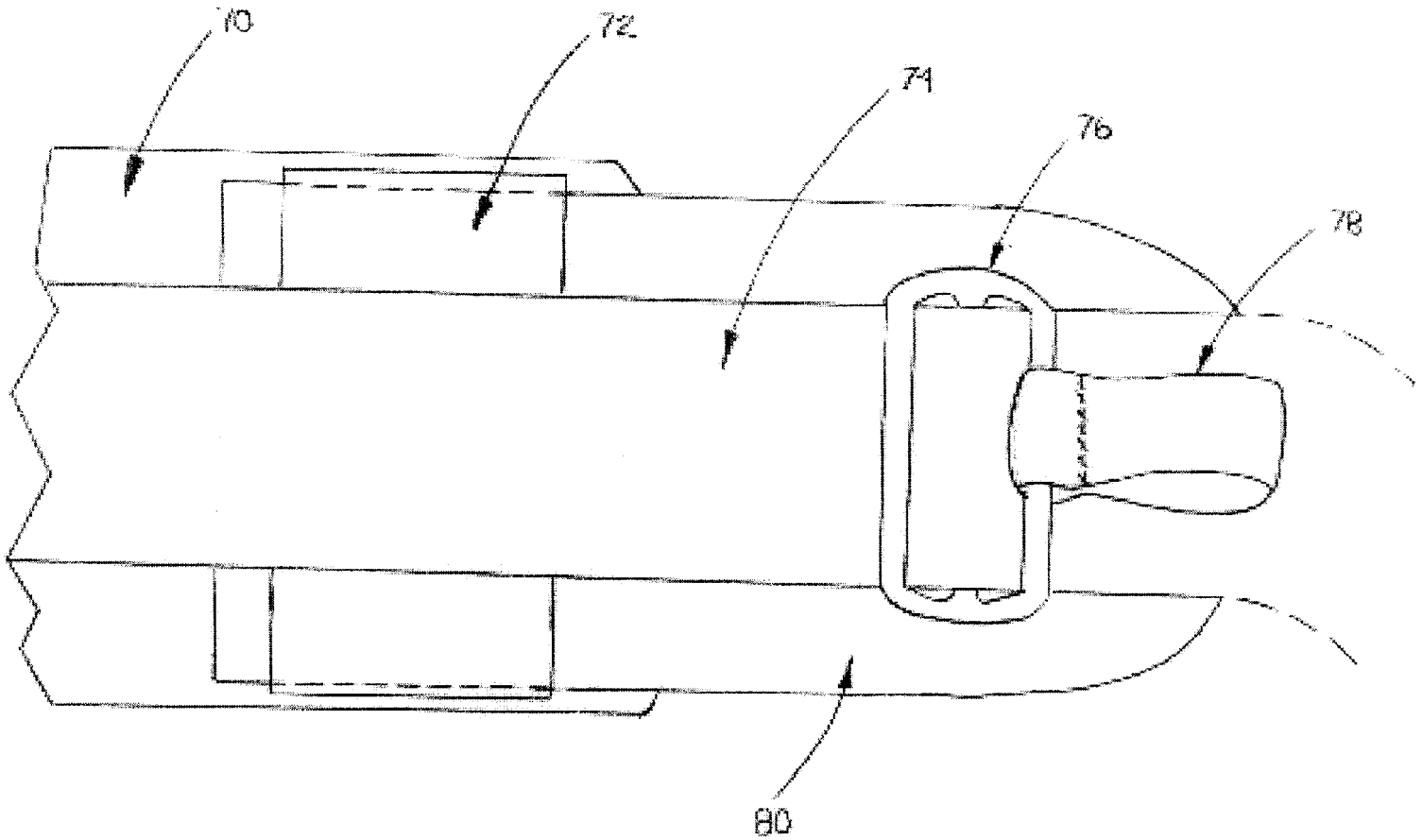
FIG. 7 illustrates a profile view of a terminal end of a further waistbelt embodiment to include a waistbelt extension.

Turning to FIG. 7, another embodiment of the present invention is illustrated shows another manner in which the waistbelt 10 may be extended. The belt band 70 no longer has a pocket in this embodiment. The belt band 70 has a strap 72 which harnesses a waistbelt extension 80. It should be prevalent to one skilled in the art that more than one strap may be used to provide the movable attachment that affixes the waistbelt extension 80 to the waistbelt 10. Furthermore, it should be prevalent that the extension of support could be fashioned in a variety of other ways. A buckling strap 74 is directly attached to the belt band 70 at points that do not interfere with a telescoping motion of the waistbelt extension 80. A sliding three-bar buckle 76 is directly attached to the waistbelt extension 80 in a manner similar to that of the sliding three bar buckle 16 to waistbelt insert 12 shown in FIGS. 5 and 6. The buckling strap 60 is woven through the sliding three-bar buckle 76 in a manner similar to that of the buckling strap 14 through the sliding three-bar buckle 16 shown in FIGS. 5 and 6. A fabric loop 78 is affixed to the sliding three-bar buckle 76 in a manner similar to that of the fabric loop 24 to the sliding three-bar buckle 16 shown in FIG. 5 and FIG. 6. This embodiment allows the user to adjust a length of the waistbelt 10 by sliding the waistbelt extension 80 along a length of the buckling strap 76 by means of the movably attached sliding three-bar buckle 76. An extended length of this further embodiment is limited by a manufactured length of the waistbelt extensions.

There are, of course, many other manners to extend the length of a waistbelt without departing from the scope of this invention.

The forgoing description is considered as illustrative only of the principles of the invention. Furthermore, since numerous modifications and changes will readily occur to those skilled in the art, it is not desired to limit the invention to the exact construction and process shown as described above. Accordingly, all suitable modifications and equivalents may be resorted to falling within the scope of the invention as defined by the claims which follow.

What is claimed is:

1. A waistbelt comprising:

a support region having a terminal end;

a first strap;

a waistbelt extension movably attached to the first strap that effectively lengthens the support region by extending outwardly from the terminal end of the support region through a guide associated with the terminal end of the support region, the guide comprising a second strap mounted proximate to the terminal end of the support region, and wherein the second strap is mounted substantially perpendicularly to a direction of movement of the waist belt extension.

2. The waistbelt of claim 1, wherein the guide comprises a pocket formed at least in part by the terminal end of the support region.

3. The waist belt of claim 1, wherein the support region comprises padding.

4. The waist belt of claim 1, wherein the waistbelt extension is harnessed.

5. An adjustable waist support system comprising a first strap;

a waistbelt extension movably attached to the first strap; and a waistbelt having a support region to be positioned over a user's hip, the support region having a terminal end, the terminal end having a guide slidably engaging the waistbelt extension and allowing expansion and contraction of the support region via telescopic moment of the waistbelt extension relative to the terminal end, the guide comprising, a second strap mounted proximate to the terminal end substantially perpendicularly to the telescopic movement of the waistbelt extension.

6. The adjustable waist support system of claim 5, wherein the support region comprises padding.

7. The adjustable waist support system of claim 5, wherein the waistbelt extension is harnessed.

8. The adjustable waist support system of claim 5, wherein the guide comprises a pocket formed in part by the terminal end.

9. The adjustable waist support system of claim 8, wherein a terminal end of the first strap is attached to the terminal end of the support region.

10. A belt having a first pocketed terminal end, a second pocketed terminal end and a length, for stabilizing a shouldered load, comprising:

a first strap directly attached to the first pocketed terminal end;

a first belt insert slidably guided within the first pocketed terminal end and providing for adjustment of the length by being movably attached to the first strap;

a second strap directly attached to the second pocketed terminal end; and a second belt insert slidably guided within the second pocketed terminal end, the second belt insert providing for adjustment of the length by being movably attached to the second strap.

11. The belt of claim 10, wherein the first strap comprises a locking mechanism movably attached to the first strap for fastening the first strap to the second strap.

12. The belt of claim 10, wherein the second strap comprises a locking mechanism movably attached to the second strap for fastening the second strap to the first strap.

13. The belt of claim 10, wherein the belt further comprises a plurality of compression straps directly attached to the belt for fastening purposes.

14. The belt of claim 10, wherein the first belt insert comprises a sliding buckle directly attached to the first belt insert for movably attaching the first belt insert to the first strap.

15. The belt of claim 14, wherein the sliding buckle comprises a fabric loop attached to the sliding buckle to provide leverage for adjusting the sliding buckle.

16. The belt of claim 10, wherein the second belt insert comprises a sliding buckle directly attached to the second belt insert.

17. The belt of claim 16, wherein the sliding buckle comprises a fabric loop attached to the sliding buckle to provide leverage for adjusting the sliding buckle.

18. A belt having a first pocketed terminal end and a length, for stabilizing a shouldered load, comprising:

a first strap directly attached to the first pocketed terminal end;

a first belt insert slidably guided within the first pocketed terminal end and providing for adjustment of the length by being movably attached to the first strap; and a plurality of compression traps directly attached to the belt for fastening purposes.

19. The belt of claim 18, wherein the first belt insert comprises a sliding buckle directly attached to the first belt insert for movably attaching the first belt insert to the first strap.

20. The belt of claim 19, wherein the sliding buckle comprises a fabric loop attached to the sliding buckle to provide leverage for adjusting the sliding buckle.

21. The belt of claim 18, wherein the belt further comprises:

a second pocketed terminal end;

a second strap directly attached to the second pocketed terminal end; and a second belt insert slidably guided within the second pocketed terminal end, the second belt insert providing for adjustment of the length by being movably attached to the second strap.

22. The belt of claim 21, wherein the first strap comprises a locking mechanism movably attached to the first strap for fastening the first strap to the second strap.

23. The belt of claim 21, wherein the second strap comprises a locking mechanism movably attached to the second strap for fastening the second strap to the first strap.

24. The belt of claim 21, wherein the second belt insert comprises a sliding buckle directly attached to the second belt insert.

25. The belt of claim 24, wherein the sliding buckle comprises a fabric loop attached to the sliding buckle to provide leverage for adjusting the sliding buckle.

26. A belt having a first pocketed terminal end and a length, for stabilizing a shouldered load, comprising:

a first strap directly attached to the first pocketed terminal end; and a first belt insert slidably guided within the first pocketed terminal end and providing for adjustment of the length by being movably attached to the first strap, the first belt insert comprising a sliding buckle directly attached to the first belt insert for movably attaching the first belt insert to the first strap.

27. The belt of claim 26, wherein the second strap comprises a locking mechanism movably attached to the second strap for fastening the second strap to the first strap.

28. The belt of claim 26, wherein the belt further comprises a plurality of compression straps directly attached to the belt for fastening purposes.

29. The belt of claim 26, wherein the sliding buckle comprises a fabric loop attached to the sliding buckle to provide leverage for adjusting the sliding buckle.

30. The belt of claim 26, wherein the belt further comprises:

a second pocketed terminal end;

a second strap directly attached to the second pocketed terminal end; and a second belt insert slidably guided within the second pocketed terminal end, the second belt insert providing for adjustment of the length by being movably attached to the second strap.

31. The belt of claim 30, wherein the first strap comprises a locking mechanism movably attached to the first strap for fastening the first strap to the second strap.

32. The belt of claim 30, wherein the second belt insert comprises a sliding buckle directly attached to the second belt insert.

33. The belt of claim 32, wherein the sliding buckle comprises a fabric loop attached to the sliding buckle to provide leverage for adjusting the sliding buckle.

34. A waistbelt having first second terminal ends and a length, comprising a first open pocket located within the first terminal end of the waistbelt;

a first strap attached directly to the first terminal end of the waistbelt;

a first waistbelt extension, inserted into the first open pocket, providing for adjustment of the length by being movably attached to the first strap;

a second open pocket located within the second terminal end of the waistbelt;

a second strap attached directly to the second terminal end of the waistbelt; and a second waistbelt extension, inserted into the second open pocket, providing for adjustment of the length by being movably attached to the second strap.

35. The waistbelt of claim 34, wherein the first strap comprises a locking mechanism movably attached to the first strap for fastening the first strap to the second strap.

36. The waistbelt of claim 34, wherein the second strap comprises a locking mechanism movably attached to the second strap for fastening the second strap to the first strap.

37. The waistbelt of claim 34, wherein the waistbelt further comprises a plurality of compression straps for fastening purposes.

38. The waistbelt of claim 34, wherein the first waistbelt extension comprises a sliding buckle directly attached to the first waistbelt extension for movably attaching the first waistbelt extension to the first strap.

39. The waistbelt of claim 38, wherein the sliding buckle comprises a fabric loop attached to the sliding buckle to provide leverage for adjusting the sliding buckle.

40. The waistbelt of claim 34, wherein the second waistbelt extension comprises a sliding buckle directly attached to the second waistbelt extension for movably attaching the second waistbelt extension to the second strap.

41. The waistbelt of claim 40, wherein the sliding buckle comprises a fabric loop attached to the sliding buckle to provide leverage for adjusting the sliding buckle.

42. A waistbelt having first and second terminal ends and a length, comprising a first open pocket locate within the first terminal end of the waistbelt;

a first strap attached directly to the first terminal end of the waistbelt;

a first waistbelt extension, inserted into the first open pocket, providing for adjustment of the length by being movably attached to the first strap; and a plurality of compression traps for fastening purposes.

43. The waistbelt of claim 42, wherein the first waistbelt extension comprises a sliding buckle directly attached to the first waistbelt extension for movably attaching the first waistbelt extension to the first strap.

44. The waistbelt of claim 43, wherein the sliding buckle comprises a fabric loop attached to the sliding buckle to provide leverage for adjusting the sliding buckle.

45. The waistbelt of claim 42, wherein the waistbelt further comprises:

a second open pocket located within the second terminal end of the waistbelt;

a second strap attached directly to the second terminal end of the waistbelt; and a second waistbelt extension, inserted into the second open pocket, providing for adjustment of the length by being movably attached to the second strap.

46. The waistbelt of claim 45, wherein the first strap comprises a locking mechanism movably attached to the first strap for fastening the first strap to the second strap.

47. The waistbelt of claim 45, wherein the second strap comprises a locking mechanism movably attached to the second strap for fastening the second strap to the first strap.

48. The waistbelt of claim 45, wherein the second waistbelt extension comprises a sliding buckle directly attached to the second waistbelt extension for movably attaching the second waistbelt extension to the second strap.

49. The waistbelt of claim 48, wherein the sliding buckle comprises a fabric loop attached to the sliding buckle to provide leverage for adjusting the sliding buckle.

50. A waistbelt having first and second terminal ends and a length, comprising a first open pocket located within the first terminal end of the waistbelt;

a first strap attached directly to the first terminal end of the waistbelt; and a first waistbelt extension, inserted into the first open pocket, providing for adjustment of the length by being movably attached to the first strap, the first waistbelt extension comprising a sliding buckle directly attached to the first waistbelt extension for movably attaching the first waistbelt extension to the first strap.

51. The waistbelt of claim 50, wherein the waistbelt further comprises a plurality of compression straps for fastening purposes.

52. The waistbelt of claim 50, wherein the sliding buckle comprises a fabric loop attached to the sliding buckle to provide leverage for adjusting the sliding buckle.

53. The waistbelt of claim 50, wherein the waistbelt further comprises:

a second open pocket located within the second terminal end of the waistbelt;

a second strap attached directly to the second terminal end of the waistbelt; and a second waistbelt extension, inserted into the second open pocket, providing for adjustment of the length by being movably attached to the second strap.

54. The waistbelt of claim 53, wherein the first strap comprises a locking mechanism movably attached to the first strap for fastening the first strap to the second strap.

55. The waistbelt of claim 53, wherein the second strap comprises a locking mechanism movably attached to the second strap for fastening the second strap to the first strap.

56. The waistbelt of claim 53, wherein the second waistbelt extension comprises a sliding buckle directly attached to the second waistbelt extension for movably attaching the second waistbelt extension to the second strap.

57. The waistbelt of claim 56, wherein the sliding buckle comprises a fabric loop attached to the sliding buckle to provide leverage for adjusting the sliding buckle.

58. A waistbelt having first and second terminal ends and a length, comprising:

a first strap directly attached to the waistbelt; and a first waistbelt extension providing for adjustment of the length by being movably attached to the first strap; and a second strap directly attached to the waistbelt at first and second terminal ends of the second strap wherein the first waistbelt extension is harnessed.

59. The waistbelt of claim 58 further comprising a plurality of compression straps directly attached to a surface of the waistbelt for fastening purposes.

60. The waistbelt of claim 58, wherein the first waistbelt extension comprises a sliding buckle directly attached to the first waistbelt extension for movably attaching the first strap to the first waistbelt extension.

61. The waistbelt of claim 60, wherein the sliding buckle comprises a fabric loop attached to the sliding buckle to provide leverage for adjusting the sliding buckle.

62. The waistbelt of claim 58, further comprising:

a second strap directly attached to the waistbelt at first and second terminal ends of the second strap;

a third strap attached directly to the second terminal end of the waistbelt; and a second waistbelt extension providing for adjustment of the length by being movably attached to the second trap.

63. The waistbelt of claim 62, wherein the waistbelt further comprises a fourth strap directly attached to the waistbelt at first and second terminal ends of the fourth strap wherein the second waistbelt extension is harnessed.

64. The waistbelt of claim 62, wherein the first strap comprises a locking mechanism movably attached to the first strap for fastening the first strap to the third strap.

65. The waistbelt of claim 64, wherein the third strap comprises a locking mechanism movably attached to the third strap for fastening the third strap to the first strap.

66. The waistbelt of claim 62, wherein the second waistbelt extension comprises a sliding buckle directly attached to the second waistbelt extension for movably attaching the third strap to the second waistbelt extension.

67. The waistbelt of claim 66, wherein the sliding buckle comprises a fabric loop attached to the sliding buckle to provide leverage for adjusting the sliding buckle.

68. A waistbelt having first and second terminal ends and a length, comprising:

a first strap directly attached to the waistbelt;

a first waistbelt extension providing for adjustment of the length by being movably attached to the first strap; and a plurality of compression straps directly attached to a surface of the waistbelt for fastening purposes.

69. The waistbelt of claim 68, wherein the first waistbelt extension comprises a sliding buckle directly attached to the first waistbelt extension for movably attaching the first strap to the first waistbelt extension.

70. The waistbelt of claim 69, wherein the sliding buckle comprises a fabric loop attached to the sliding buckle to provide leverage for adjusting the sliding buckle.

71. The waistbelt of claim 68 further comprising a second strap directly attached to the waistbelt at first and second terminal ends of the second strap wherein the first waistbelt extension is harnessed.

72. The waistbelt of claim 71, wherein the second waistbelt extension comprises a sliding buckle directly attached to the second waistbelt extension for movably attaching the third strap to the second waistbelt extension.

73. The waistbelt of claim 72, wherein the sliding buckle comprises a fabric loop attached to the sliding buckle to provide leverage for adjusting the sliding buckle.

74. The waistbelt of claim 68 further comprising:

a second strap directly attached to the waistbelt at first and second terminal ends of the second strap;

a third strap attached directly to the second terminal end of the waistbelt; and a second waistbelt extension providing for adjustment of the length by being movably attached to the second strap.

75. The waistbelt of claim 74, wherein the waistbelt further comprises a fourth strap directly attached to the waistbelt at first and second terminal ends of the fourth strap wherein the second waistbelt extension is harnessed.

76. The waistbelt of claim 75, wherein the first strap comprises a locking mechanism movably attached to he first strap for fastening the first strap to the third strap.

77. The waistbelt of claim 76, wherein the third strap comprises a locking mechanism movably attached to the third strap for fastening the third strap to the first strap.

78. A waistbelt having first and second terminal ends and a length, comprising:

a first strap directly attached to the waistbelt; and a first waistbelt extension providing for adjustment of the length by being movably attached to the first strap, the first waistbelt extension comprising a sliding buckle directly attached to the first waistbelt extension for movably attaching the first strap to the first waistbelt extension.

79. The waistbelt of claim 78 further comprises a second strap directly attached to the waistbelt at first and second terminal ends of the second strap wherein the first waistbelt extension is harnessed.

80. The waistbelt of claim 78 further comprises a plurality of compression straps directly attached to a surface of the waistbelt for fastening purposes.

81. The waistbelt of claim 78, wherein the sliding buckle comprises a fabric loop attached to the sliding buckle to provide leverage for adjusting the sliding buckle.

82. The waistbelt of claim 78 further comprises:

a second strap directly attached to the waistbelt at first and second terminal ends of the second strap;

a third strap attached directly to the second terminal end of the waistbelt; and a second waistbelt extension providing for adjustment of the length by being movably attached to the second trap.

83. The waistbelt of claim 82, wherein the waistbelt further comprises a fourth strap directly attached to the waistbelt at first and second terminal ends of the fourth strap wherein the second waistbelt extension is harnessed.

84. The waistbelt of claim 82, wherein the first strap comprises a locking mechanism movably attached to the first strap for fastening the first strap to the third strap.

85. The waistbelt of claim 82, wherein the third strap comprises a locking mechanism movably attached to the third strap for fastening the third strap to the first strap.

86. The waistbelt of claim 82, wherein the second waistbelt extension comprises a sliding buckle directly attached to the second waistbelt extension for movably attaching the third strap to the second waistbelt extension.

87. The waistbelt of claim 86 wherein the sliding buckle comprises a fabric loop attached to the sliding buckle to provide leverage for adjusting the sliding buckle.

88. A waistbelt having first and second terminal ends and a length, comprising:

a first strap directly attached to the waistbelt;

a first waistbelt extension providing for adjustment of the length by being movably attached to the first strap;

a second strap directly attached to the waistbelt at first and second terminal ends of the second strap;

a third strap attached directly to the second terminal end of the waistbelt; and a second waistbelt extension providing for adjustment of the length by being movably attached to the second strap.

89. The waistbelt of claim 88, wherein the first waistbelt extension is harnessed.

90. The waistbelt of claim 88, wherein the waistbelt further comprises a fourth strap directly attached to the waistbelt at first and second terminal ends of the fourth strap wherein the second waistbelt extension is harnessed.

91. The waistbelt of claim 88 further comprises a plurality of compression straps directly attached to a surface of the waistbelt for fastening purposes.

92. The waistbelt of claim 88, wherein the first strap comprises a locking mechanism movably attached to the first strap for fastening the first strap to the third strap.

93. The waistbelt of claim 92, wherein the third strap comprises a locking mechanism movably attached to the third strap for fastening the third strap to the first strap.

94. The waistbelt of claim 88, wherein the first waistbelt extension comprises a sliding buckle directly attached the first waistbelt extension for movably attaching the first strap to the first waistbelt extension.

95. The waistbelt of claim 94, wherein the sliding buckle comprises a fabric loop attached to the sliding buckle to provide leverage for adjusting the sliding buckle.

96. The waistbelt of claim 88, wherein the second waistbelt extension comprises a sliding buckle directly attached to the second waistbelt extension for movably attaching the third strap to the second waistbelt extension.

97. The waistbelt of claim 96, wherein the sliding buckle comprises a fabric loop attached to the sliding buckle to provide leverage for adjusting the sliding buckle.

98. A backpack system comprising:

a backpack within which a load may be carried on a user's back;

one or more compression straps coupled to the backpack; and an adjustable waist support system coupled to the one or more compression straps, the adjustable waist support system comprising a support region to be place over the user's hips, the support region having a terminal end;

a first strap; and a waistbelt extension movably attached to the first strap that effectively lengthens the support region by extending outwardly from the terminal end of the support region through a guide associated with the terminal end of the support region, the guide comprising a pocket formed at least in part by the terminal end of the support region.

99. The waist belt of claim 98, wherein the support region comprises padding.

100. The waist belt of claim 98, wherein the waistbelt extension is harnessed.

101. A backpack system comprising:

a backpack within which a load may be carried on a user's back;

one or more compression straps coupled to the backpack; and an adjustable waist support system coupled to the one or more compression straps, the adjustable waist support system comprising a support region to be place over the user's hips, the support region having a terminal end;

a first strap; and a waistbelt extension movably attached to the first strap that effectively lengthens the support region by extending outwardly from the terminal end of the support region through a guide associated with the terminal end of the support region, the guide comprising a second strap mounted proximate to the terminal end of the support region, and wherein the second strap is mounted substantially perpendicularly to a direction of movement of the waistbelt extension.

102. The waist belt of claim 101, wherein the support region comprises padding.

103. The waist belt of claim 101, wherein the waistbelt extension is harnessed.

* * * * *